US005354078A

United States Patent [19]

BelleIsle

[11] Patent Number: 5,354,078

[45] Date of Patent: Oct. 11, 1994

[54] SKATE BLADE

[76] Inventor: Merritt E. BelleIsle, 76 Parish Rd., Needham, Mass. 02194

[21] Appl. No.: 13,388

[22] Filed: Feb. 4, 1993

[51] Int. Cl.[5] ..... A63C 1/32

[52] U.S. Cl. ..... 280/11.18

[58] Field of Search ..... 280/11.12, 11.18, 841, 280/11.14, 11.15, 11.17

[56] References Cited

U.S. PATENT DOCUMENTS

| | | | |
|---|---|---|---|
| 115,487 | 5/1871 | Lank | 280/11.18 |
| 1,100,976 | 6/1914 | Hille | 280/11.18 |
| 1,702,695 | 2/1929 | Hoult | 280/11.18 X |
| 3,292,940 | 12/1966 | Weitzner | 280/11.18 X |
| 4,392,658 | 7/1983 | Redmond et al. | 280/11.18 |

FOREIGN PATENT DOCUMENTS

| | | | |
|---|---|---|---|
| 269583 | 1/1914 | Fed. Rep. of Germany | 280/11.18 |

*Primary Examiner*—Margaret A. Focarino
*Assistant Examiner*—Michael Mar
*Attorney, Agent, or Firm*—John E. Toupal; Harold G. Jarcho

[57] ABSTRACT

An elongated blade including a longitudinally curved first cutting edge formed on one side of the blade and for providing cutting engagement with an ice surface; a longitudinally curved second cutting edge formed on an opposite side of the blade and for providing cutting engagement with the ice surface, the second cutting edge being substantially parallel to the first cutting edge; a longitudinally extending, substantially planar first face projecting transversely and upwardly from the first cutting edge and forming with the horizontal an angle of between 1.5° and 2°; a longitudinally extending, substantially planar second face projecting transversely and upwardly from the second cutting edge and forming with the horizontal an angle between 1.5° and 2°, the second face intersecting the first face so as to form therewith an elongated trough; and mounting means for attachment of the blade to a boot. The blade provides for skaters an improved combination of both speed and control.

14 Claims, 1 Drawing Sheet

SKATE BLADE

BACKGROUND OF THE INVENTION

This invention relates generally to a skate blade and, more particularly, to a skate blade bottom surface profile that enhances skating performance.

Prior skate blades have been designed with bottom surface profiles particularly suitable for the specific activity in which they are to be used. For example, speed skaters generally utilize skate blades with substantially flat bottom surfaces that minimize friction with the ice and thereby improve speed. Conversely, skaters such as figure skaters desiring a high degree of maneuverability prefer blades having a concave transverse cross section extending between cutting edges formed at opposite sides of the blades. The cutting edges penetrate the ice surface to enhance the ability of a skater to maneuver. However, other skaters such as hockey players desire during different stages of play either high speed or good maneuverability and prior hollow ground blades have not optimized both speed and maneuverability which factors are oppositely affected by the degree of concavity ground into a blade.

Other blade designs have been proposed in attempts to compensate for the conflicting objectives of speed and maneuverability. For example, U.S. Pat. No. 1,100,976 discloses a three part structure including a rounded central blade for smooth travel on an ice surface and straddling beveled side blades each providing a cutting edge for penetration of the ice surface. The side blades are adjustable relative to the central blade so as to facilitate optimization of either "speed skating" or "fancy skating". No adjustment of the disclosed three part blade structure will provide simultaneously, however, a degree of both speed and maneuverability. U.S. Pat. No. 3,292,940 discloses a two part blade structure in which a pair of elongated blades are bolted together to form a single blade. Each of the joined blades has an inwardly and upwardly beveled bottom surface that forms elongated side cutting edges. However, the excessively inclined beveled surfaces reduce attainable skating speed and inadvertently induce excessively abrupt stops that can cause falls and injury. A one piece blade similar to the above described three part blade is disclosed in U.S. Pat. No. 4,392,658. The disclosed blade has a longitudinally extending, flat or convex middle face straddled by longitudinally extending acute-angled cutting edges for penetrating an ice surface. Joining the cutting edges and middle face are longitudinally extending edge faces extending upwardly and inwardly therebetween. Although the patent's disclosure contemplates improved maneuverability without a sacrifice of speed, the disclosed blade fails to provide fully satisfactory performance for skaters requiring a high degree of both speed and maneuverability. In addition, the complex profile of the disclosed blade's lower skating surface is difficult to maintain during use.

The object of this invention, therefore, is to provide an improved blade that improves the level of attainable speed and maneuverability on ice skates.

SUMMARY OF THE INVENTION

The invention is an elongated blade including a longitudinally curved first cutting edge formed on one side of the blade and for providing cutting engagement with an ice surface; a longitudinally curved second cutting edge formed on an opposite side of the blade and for providing cutting engagement with the ice surface, the second cutting edge being substantially parallel to the first cutting edge; a longitudinally extending, substantially planar first face projecting transversely and upwardly from the first cutting edge and forming with the horizontal an angle of between 1.5° and 2°; a longitudinally extending, substantially planar second face projecting transversely and upwardly from the second cutting edge and forming with the horizontal an angle between 1.5° and 2°, the second face intersecting the first face so as to form therewith an elongated trough; and mounting means for attachment of the blade to a boot. The blade provides for skaters an improved combination of both speed and control.

According to certain features of the invention, the trough has a V-shaped cross-section, each of the first and second faces has a width of about 0.06 inch, and each of the first and second cutting edges is vertically spaced from an apex of the trough by a distance of about 0.001 inch. These structural features further enhance skating performance.

According to another feature of the invention, each of the angles is about 1.79°. Optimum skating performance is provided by this geometric feature.

According to yet another feature of the invention, the blade includes a substantially vertical side face projecting upwardly from each of the first and second cutting edges. The vertical side faces enhance desired ice penetration.

According to an additional feature of the invention, the blade is an integrally formed one piece unit. This feature reduces blade cost and facilitates the maintenance of proper edge sharpness and alignment.

DESCRIPTION OF THE DRAWINGS

These and other objects and features of the invention will become more apparent upon a perusal of the following description taken in conjunction with the accompanying drawings wherein.

DESCRIPTION OF THE PREFERRED EMBODIMENT

Figure 1:
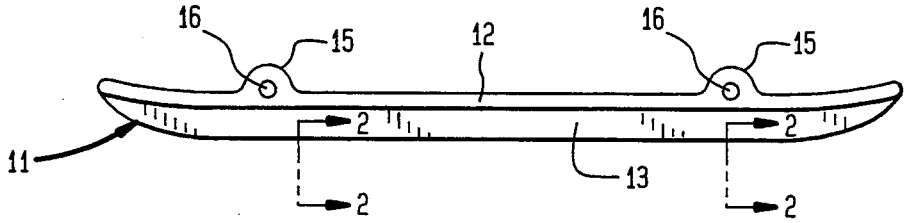
FIG. 1 is a side view of an ice skate blade according to the invention.

An elongated blade 11 including a longitudinally extending upper body portion 12 and a longitudinally extending lower body portion 13. The upper body portion 12 is inwardly stepped from both sides of the lower body portion 13. Formed at longitudinally spaced apart positions on an upper edge of the upper body portion 12 are mounting flanges 15 having apertures 16. The blade 11 preferably is an integrally formed single piece formed from a suitable material such as stainless steel. Longitudinally, the blade 11 is curved in a conventional manner. During use of the blade 11, the apertured mounting flanges 16 facilitate bolting attachment of the upper body portion 12 to a conventional holding bracket (not shown) of a conventional skate boot (not shown).

Figure 2:
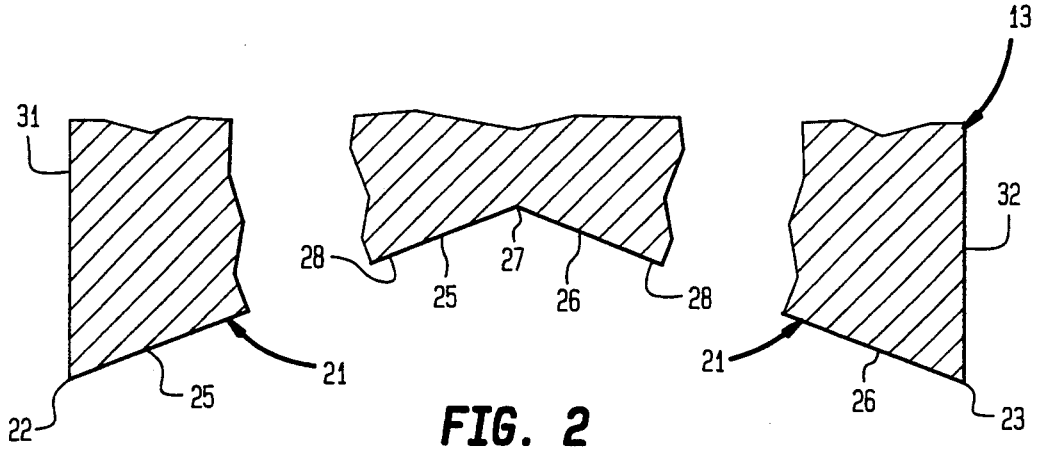
FIG. 2 is a transverse cross-sectional view taken along lines 2—2 of FIG. 1.

As shown in FIG. 2, the lower body portion 13 has a bottom surface 21 extending transversely between a longitudinally curved first cutting edge 22 and a longitudinally curved second cutting edge 23. Forming the bottom surface are a longitudinally extending first planar face 25 extending upwardly and transversely inwardly from the first cutting edge 22 and a longitudinally extended second planar face 26 extending upwardly and transversely inwardly from the second cutting edge 23. The first face 25 intersects the second face 26 along a linear apex 27 that defines the bottom of an elongated trough 28 having a V-shaped cross-section. Extending vertically upwardly from the first cutting edge 22 is a vertical side face 31 on one side of the lower body portion 13. An opposite side of the lower body portion 13 is formed by a vertical side face 32 projecting upwardly from the second cutting edge 23.

Figure 3:
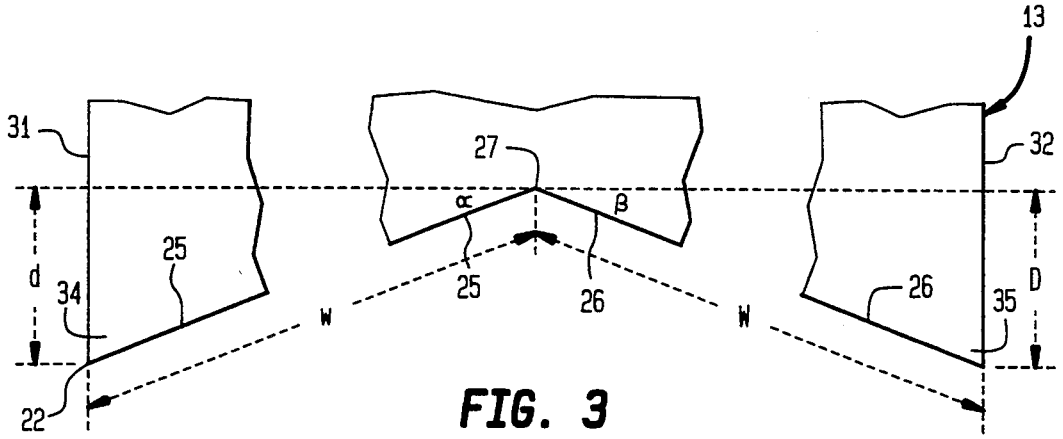
FIG. 3 is a diagramatic transverse cross-sectional view of the blade shown in FIGS. 1 and 2.

As illustrated in FIG. 3, the first planar face 25 forms with the horizontal an angle $\alpha$ while the second planar face 26 forms with the horizontal an angle $\beta$. Preferably, the angles $\alpha$ and $\beta$ are equal and in a range between 1.5° and 2°. In a specifically preferred form of the blade 11, each of the angles $\alpha$ and $\beta$ is about 1.79°.

The first planar face 25 has a width w while the second planar face 26 has a width W. Preferably, the widths w and W are equal as shown in FIG. 3 and have a magnitude of about 0.06 inches. As also illustrated in FIG. 3, the first cutting edge 22 is vertically spaced from the apex 27 by a distance d and the second cutting edge 23 is vertically spaced from the apex 27 by a distance D. Preferably, the distances d and D are equal and of a magnitude of about 0.001 inches.

During use of the blade 11, the first and second cutting edges 22 and 23 undergo cutting engagement with an ice surface. The degree to which the first and second edges 22 and 23 penetrate the ice is variable and will depend upon a number of factors including the weight of the skater, dynamic conditions, temperature and hardness of ice. However, under any given set of conditions, the first and second cutting edges 22, 23 will experience less ice penetration than would the edges of a blade with a conventionally ground concave bottom surface. Because of the reduced penetration of the cutting edges 22, 23, the total area of a first and second faces 25, 26 and the first and second side faces 31, 32 engaging the ice is reduced to correspondingly reduce ice friction and enhance attainable skating speed. The speed attainable with the blade 11 is comparable to that provided by a conventional flat bottom blade typically used by speed skaters. In addition, skating control and maneuverability are improved by the presence of the first and second cutting edges 22, 23. However, a reduction in the size of the angles $\alpha$ and $\beta$ to less than the above noted value of 1.5° will significantly reduce skating control and maneuverability. Conversely, increasing the size of the angles $\alpha$ and $\beta$ to above the aforementioned value of 2° will increase the occurrence of undesirably abrupt stops that can cause falling or injury of a skater.

The relatively simple profile of the V-shaped trough 28 is easily maintained by conventional grinding and polishing techniques. Such sharpening operations are required less frequently than for conventional concave skate surfaces because the elongated V-shaped wedges 34, 35 terminated by the first and second cutting edges 22, 23 provide more material than do conventional concave ground blades. Thus, required maintenance costs and time are reduced.

Obviously, many modifications and variations of the present invention are possible in light of the above teachings. It is to be understood, therefore, that the invention can be practiced otherwise than as specifically described.

What is claimed is:

1. An elongated integrally formed one piece blade for an ice skate and comprising:

a longitudinally curved first cutting edge formed on a lower of one side of said blade and for providing cutting engagement with an ice surface;

a longitudinally curved second cutting edge formed on a lower of an opposite side of said blade and for providing cutting engagement with the ice surface, said second cutting edge being substantially parallel to said first cutting edge;

a longitudinally extending, substantially planar first bottom face projecting transversely inwardly and upwardly from said first cutting edge and forming with the horizontal an angle of between 1.5° and 2°;

a longitudinally extending, substantially planar second bottom face projecting transversely inwardly and upwardly from said second cutting edge and forming with the horizontal an angle between 1.5° and 2°, said second face intersecting said first face so as to form therewith an elongated trough having a V-shaped cross section; and mounting means for attachment of said blade to a boot.

2. A blade according to claim 1 wherein each of said first and second faces has a width of about 0.06 inch.

3. A blade according to claim 1 wherein each of said first and second cutting edges is vertically spaced from an apex of said trough by a distance of about 0.001 inch.

4. A blade according to claim 1 wherein each of said angles is about 1.79°.

5. A blade according to claim 1 wherein each of said first and second faces has a width of about 0.06 inch.

6. A blade according to claim 5 wherein each of said first and second cutting edges is vertically spaced from an apex of said trough by a distance of about 0.001 inch.

7. A blade according to claim 6 wherein each of said angles is about 1.79°.

8. A blade according to claim 1 wherein each of said first and second faces has a width of about 0.06 inch.

9. A blade according to claim 8 wherein each of said first and second cutting edges is vertically spaced from an apex of said trough by a distance of about 0.001 inch.

10. A blade according to claim 9 wherein each of said angles is about 1.79°.

11. A blade according to claim 1 further comprising a substantially vertical side face projecting upwardly from each of said first and second cutting edges.

12. A blade according to claim 11 wherein each of said first and second faces has a width of about 0.06 inch.

13. A blade according to claim 12 wherein each of said first and second cutting edges is vertically spaced from an apex of said trough by a distance of about 0.001 inch.

14. A blade according to claim 13 wherein each of said angles is about 1.79°.

* * * * *